United States Patent [19]

Knight

[11] Patent Number: 5,043,147

[45] Date of Patent: Aug. 27, 1991

[54] COMBINED MUFFLER AND CATALYTIC CONVERTER EXHAUST UNIT

[76] Inventor: Glen Knight, P.O. Box 217, Pouch Cove, Newfoundland, Canada, A0A 3L0

[21] Appl. No.: 451,314

[22] Filed: Dec. 15, 1989

[51] Int. Cl.[5] ..... B01D 53/34; B01D 53/36; F01N 3/10

[52] U.S. Cl. ..... 422/180; 422/170; 422/171; 422/176; 422/177; 55/276; 55/DIG. 30; 60/299; 60/302; 181/232; 181/258; 181/264

[58] Field of Search ..... 422/170, 171, 176, 177, 422/180; 55/276, DIG. 30; 60/299, 302; 181/232, 258, 264

[56] References Cited

U.S. PATENT DOCUMENTS

| | | | |
|---|---|---|---|
| 3,807,173 | 4/1974 | Zmuda et al. | 422/171 X |
| 4,056,934 | 11/1977 | Mizusawa et al. | 181/264 X |
| 4,124,091 | 11/1978 | Mizusawa | 181/258 X |
| 4,541,240 | 9/1985 | Monro | 55/DIG. 30 X |
| 4,579,194 | 4/1986 | Shiki et al. | 181/262 X |
| 4,846,302 | 7/1989 | Hetherington | 181/258 X |
| 4,894,987 | 1/1990 | Harwood et al. | 60/299 |
| 4,916,105 | 4/1990 | Rieck et al. | 502/302 X |

*Primary Examiner*—Robert J. Warden
*Assistant Examiner*—Stephanie Blythe
*Attorney, Agent, or Firm*—Berman, Aisenberg & Platt

[57] ABSTRACT

There is provided a new and useful combined muffler and catalytic converter exhaust unit for the exhaust stream from an internal combustion engine, the combined unit comprising a housing having an inlet and an outlet, first and second chambers within the housing, an oxidation/reduction catalyst within the first chamber, noise muffling means within the second chamber, and wherein the first chamber has an inlet leading to the inlet of the housing and an outlet leading to an inlet of the second chamber, and the second chamber has an outlet leading to the outlet of the housing.

8 Claims, 1 Drawing Sheet

COMBINED MUFFLER AND CATALYTIC CONVERTER EXHAUST UNIT

This application relates to combined muffler and catalytic converter exhaust units for use in the exhaust system of an internal combustion engine.

BACKGROUND OF THE INVENTION

It has long been recognized that internal combustion engines, and particularly those in use in motor vehicles are a major source of atmospheric pollution. Government regulations have thus been put in place in many countries to force motor vehicle manufacturers to devise ways of reducing the amount of pollutants being emitted by motor vehicles. The current solution generally adopted by motor vehicle manufacturers is to pass the engine exhaust stream through a catalytic converter to reduce or eliminate by oxidation and reduction various of the pollutants in the exhaust stream.

As is well known, noise mufflers are a standard part of a motor vehicle exhaust system.

Catalytic converters have generally been positioned in the exhaust system as a separate unit between the engine exhaust manifold and the muffler.

This arrangement has been generally satisfactory to accomplish the pollutant reduction function. However, it has lead to a number of subsidiary problems. The most serious of these is that the catalytic converter unit can be removed by any person with reasonable mechanical skills and replaced by a straight and unrestricted exhaust pipe section. Because of the expense in replacing the catalytic converter when an original unit is for one reason or another no longer useable, this replacement by a straight through section of exhaust pipe has frequently been adopted. This substitution obviously completely defeats the objective of the catalytic converter, pollution control.

The present invention eliminates this removal problem by combining in a single unit the catalytic converter and the muffler.

While the above discussion has related to problems with the catalytic converter, motor vehicle mufflers have also presented problems. A major one of these is that mufflers are prone to rust out partly as a result of condensation within the muffler after the engine has been shut down. The present invention reduces this condensation and thus can contribute to extended muffler life.

PRIOR ART

Systems have been proposed in which catalytic converters and mufflers have been combined in a single unit. However, such systems have generally comprised simply substantially filling a housing with ceramic impregnated catalyst and causing the engine exhaust to pass through the housing.

One such unit is addressed in Canadian Patent 721,202, issued Nov. 9, 1965, to W. R. Grace & Co. A second such system is noted in Canadian Patent 796,934, issued Oct. 22, 1968, to Texaco Development Corporation.

The present invention differs completely in structure and operation from anything described in these patents.

BRIEF SUMMARY OF THE INVENTION

A combined muffler and catalytic converter exhaust unit has now been developed which offers substantial advantages over prior art such systems.

The invention provides a combined muffler and catalytic converter exhaust unit for the exhaust stream of an internal combustion engine, the combined unit comprising a housing having an inlet and an outlet, first and second chambers within the housing, an oxidation/reduction catalyst within the first chamber, noise muffling means within the second chamber, and wherein the first chamber has an inlet leading to the inlet of the housing and an outlet leading to an inlet of the second chamber, and the second chamber has an outlet leading to the outlet of the housing.

In a preferred embodiment the first and second chambers are arranged in side by side configuration relative to the direction of travel of the exhaust stream.

BRIEF DESCRIPTION OF THE DRAWINGS

In drawings which illustrate embodiments of the invention.

Figure 2:
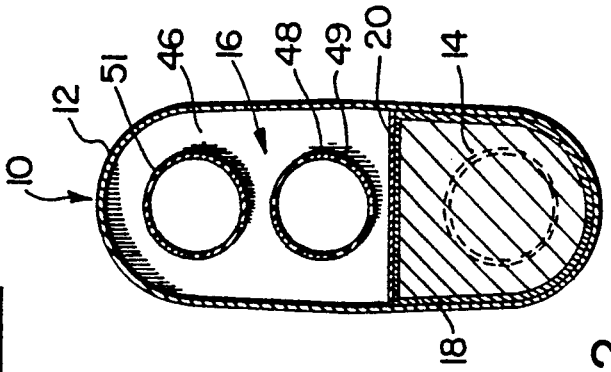
FIG. 2 is a transverse cross section of the unit of FIG. 1.
Figure 1:
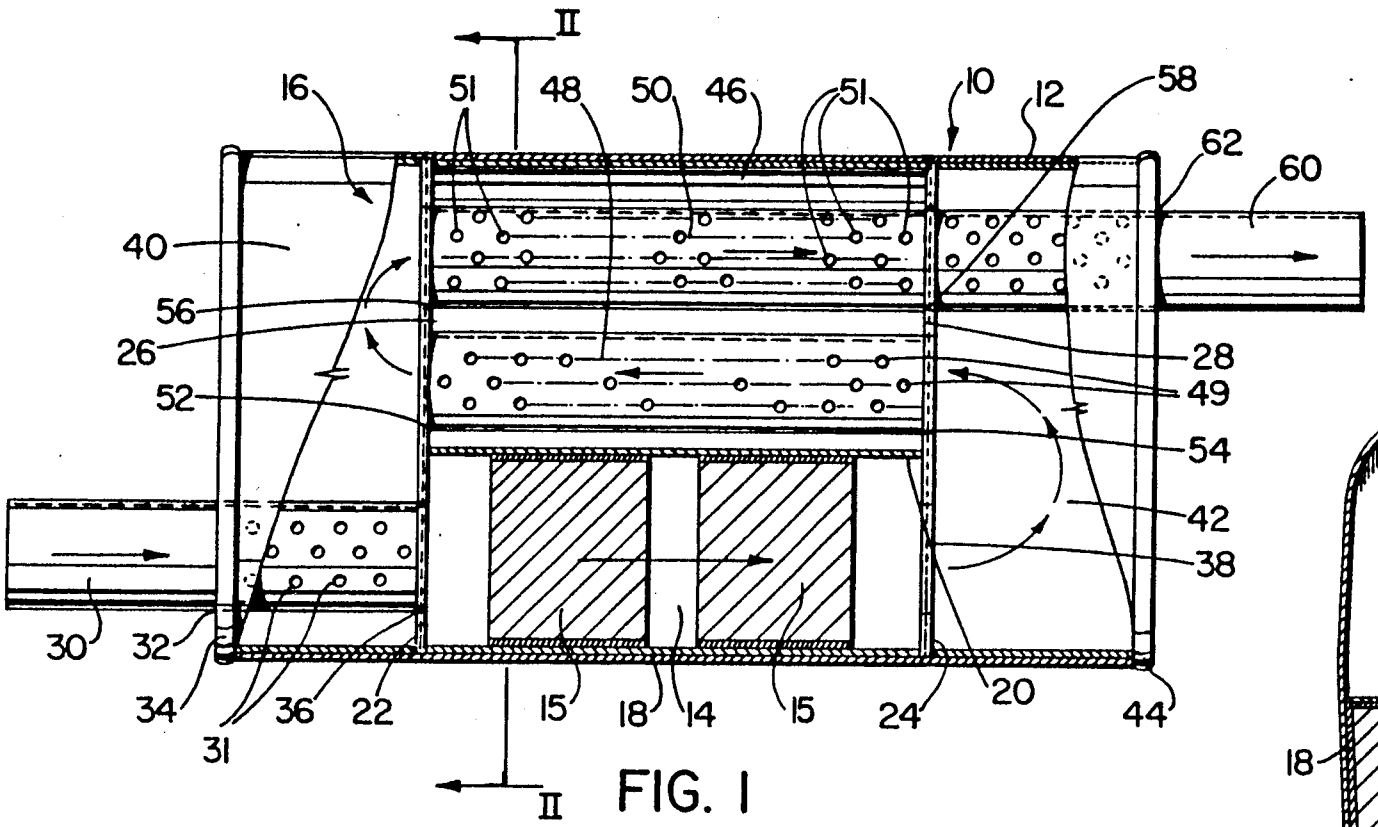
FIG. 1 is a plan view partially cut away of an exhaust unit according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The exhaust unit 10 comprises a housing 12 which includes first and second chambers 14 and 16 respectively.

The chamber 14 is defined by a section 18 of housing 12, a separator plate 20 and sections 22 and 24 of baffles 26 and 28.

A perforated exhaust inlet pipe 30 leads through inlet opening 32 in the inlet end 34 of housing 12 to inlet 36 of first chamber 14. An outlet opening 38 from chamber 14 is provided in the baffle section 24.

An oxidation/reduction catalyst, preferably a palladium and rhodium catalyst, is housed within the first chamber 14. In the preferred case the catalyst is supported on biscuit-type support structures. The preferred support structure is stainless steel in a honeycomb pattern.

Biscuit type catalyst-containing cannisters 15 are available commercially and are in current use in motor vehicle catalytic converters.

In the preferred configuration the second chamber 16 comprises end spaces 40 and 42, the first between baffle 26 and end 34 and the second between baffle 28 and end 44. Second chamber 16 further comprises the space 46 between the baffles 26 and 28. As illustrated in the preferred configuration, a pair of perforated pipes 48 and 50 are secured within space 46. Openings 52 and 54 are provided in baffles 26 and 28 at the ends of perforated pipe 48; and openings 56 and 58 are provided in baffles 26 and 28 at the ends of perforated pipe 50. An outlet pipe 60 connects an outlet opening 62 in the end 44 of housing 12 with the opening 58 and perforated pipe 50.

In general terms the flow pattern of an exhaust stream entering the inlet pipe 30 is first through inlet 36 to chamber 14. There is some interchange of the exhaust stream between pipe 30 and chamber 42 through perforations 31. The stream then moves through chamber 14 and outlet 38 in baffle section 24 to end space 40. The outlet pipe 60 covers the opening 58 in baffle 28 so that the stream moves out of end space 40 through opening 54 into perforated pipe 48. From perforated pipe 48 there is some interchange of the exhaust stream with space 46 through perforations 49 and the remainder continues through opening 52 in baffle 26 to end space 42. The stream then continues through opening 56 into perforated pipe 50 and hence through opening 58 into outlet pipe 60. As well, there is some interchange of the exhaust stream between space 46 and pipe 50 through perforations 51.

In the preferred case at least a part of the first chamber 14 is insulated with asbestos. The asbestos is preferably applied in a liquid form. Typically a one centimeter thick asbestos coating is suitable. The insulation has the dual advantage that excessive heat does not penetrate the housing 12 and that, in the initial stages of vehicle operation, the catalytic converter is more quickly heated to the required reaction temperature.

The combined unit offers a number of advantages. These include decreased weight over separate converter and muffler units. Decreased weight is of substantial importance in up to date automobiles as a means of increasing the power to weight ratio to thereby increase distance travelled per unit of fuel consumed.

Furthermore, the manufacturing cost of the combined unit is dramatically decreased over that for separate converter and muffler units.

Furthermore, the increased heat available within the unit housing for a longer period of time after engine shutdown reduces condensation in the muffler section of the unit. This condensation reduction retards rust formation and increases the life expectancy of the muffler part of the unit.

Tests have established that the combined unit is effective to reduce pollutants to the required level and that it can withstand the high temperatures reached by the converter part of the unit under highway conditions.

Various configurations of both the converter and muffler parts of the unit will be found to be suitable for the invention.

Thus it is apparent that there has been provided in accordance with the invention combined muffler and catalytic converter exhaust units that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A combined muffler and catalytic converter comprising:

an elongate housing having inlet and outlet ends joined by a body section, inlet and outlet openings respectively in said inlet and outlet ends, first and second transverse baffle plates across said body section spaced respectively from said first and second ends, and a separator plate in said body section extending between said baffles;

said housing, baffles and plate defining (i) a first expansion chamber between said outlet end and said second baffle, (ii) a second expansion chamber between said inlet end and said first baffle, (iii) a converter chamber between said first and second baffles on a first side of said plate, said converter chamber having an inlet and an outlet opening respectively in said first and second baffles, and (iv) a resonance chamber between said first and second baffles on a second side of said plate, said resonance chamber having a first resonance chamber inlet through said second baffle from said first expansion chamber, a first resonance chamber outlet into said second expansion chamber through said first baffle, a second resonance chamber inlet from said second expansion chamber through said first baffle, and a second resonance chamber outlet through said second baffle;

an inlet pipe from said inlet of said housing to said inlet of said converter chamber;

a first perforated pipe extending between said first resonance chamber inlet and said first resonance chamber outlet and a second perforated pipe extending between said second resonance chamber inlet and said second resonance chamber outlet;

an outlet pipe between a second resonance chamber outlet and said outlet of said housing; and an oxidation/reduction catalyst in said converter chamber;

whereby, subject to cross-flows through perforations of said perforated pipes, a flow path is defined through said inlet pipe, through said converter chamber, through said first expansion chamber, through said first perforated pipe, through said second expansion chamber, through said second perforated pipe and finally through said outlet pipe.

2. The exhaust unit of claim 1 wherein the catalyst is coated on a support structure.

3. The exhaust unit of claim 1 wherein the catalyst is coated onto a honeycomb support structure.

4. The exhaust unit of claims 2 or 3 wherein the support structure is of stainless steel.

5. The exhaust unit of claims 2 or 3 wherein the catalyst is palladium and rhodium.

6. The exhaust unit of claim 1 wherein said converter chamber is asbestos insulated.

7. The exhaust unit of claim 1 wherein said catalyst is supported on a biscuit structures.

8. The exhaust unit of claim 7 wherein of said converter chamber contains two said catalyst structure.

* * * * *